US010315738B2

(12) United States Patent
Imel et al.

(10) Patent No.: US 10,315,738 B2
(45) Date of Patent: Jun. 11, 2019

(54) SMALL WATERCRAFT LAUNCH

(71) Applicant: E-Z-DOCK, INC., Monett, MO (US)

(72) Inventors: Dustin Imel, Rocky Comfort, MO (US); Adam Wald, Fort Smith, AR (US); Larry D. Molohon, Westfield, IN (US)

(73) Assignee: E-Z-DOCK, INC., Monett, MO (US)

( * ) Notice: Subject to any disclaimer, the term of this patent is extended or adjusted under 35 U.S.C. 154(b) by 0 days.

(21) Appl. No.: 15/704,791

(22) Filed: Sep. 14, 2017

(65) Prior Publication Data

US 2018/0148143 A1 May 31, 2018

Related U.S. Application Data

(60) Provisional application No. 62/428,365, filed on Nov. 30, 2016.

(51) Int. Cl.

| | |
|---|---|
| ***B63B 35/44*** | (2006.01) |
| ***E02B 3/00*** | (2006.01) |
| ***B63C 1/02*** | (2006.01) |
| ***B63B 35/38*** | (2006.01) |
| *B63B 35/71* | (2006.01) |

(52) U.S. Cl.

CPC ..... *B63C 1/02* (2013.01); *B63B 35/38* (2013.01); *B63B 2035/715* (2013.01)

(58) Field of Classification Search

CPC .... B63C 1/02; B63C 1/12; B63C 3/02; B63C 3/08; B63C 3/12

USPC ..... 114/258, 259, 263, 264, 266, 267, 365, 114/366, 375, 376

See application file for complete search history.

(56) References Cited

U.S. PATENT DOCUMENTS

| | | | | |
|---|---|---|---|---|
| 3,412,702 A | | 11/1968 | Mann | |
| 3,603,276 A | * | 9/1971 | De Lisle | B63C 1/02 114/263 |
| 3,727,415 A | * | 4/1973 | Williams | B63C 1/02 405/3 |
| 3,951,087 A | * | 4/1976 | Carson | B63C 1/02 114/45 |

(Continued)

OTHER PUBLICATIONS

Golden Boat Lifts Kayak Launch web page www.goldenboatlifts.com/kayaklaunch.php, printed Feb. 17, 2016 (2 pages).

(Continued)

*Primary Examiner* — Daniel V Venne

(74) *Attorney, Agent, or Firm* — Sandberg Phoenix von Gontard, P.C.

(57) ABSTRACT

A small watercraft launch comprises a watercraft receiving area defined by a bottom and side walls which in combination define a cradle. Opposed launch side walls extend upwardly from the cradle side walls. At least one of the side walls defines a port to enable access to the cradle (and to a watercraft positioned in the cradle). A plurality of aligned notches extending downwardly from the top surface of the side walls on opposite sides of the port which are sized to receive an oar/paddle shaft to allow a boater to pull the small watercraft forward along the small watercraft launch. Lastly, the small watercraft launch has a connecting portion at a bottom of the outer surface of at least one of the launch side walls configured to connect the small watercraft launch to a dock member.

17 Claims, 8 Drawing Sheets

(56) References Cited

U.S. PATENT DOCUMENTS

| | | | | |
|---|---|---|---|---|
| 5,078,071 | A * | 1/1992 | Miura | B63C 1/02 114/263 |
| 5,131,342 | A | 7/1992 | Sackett | |
| 5,184,913 | A * | 2/1993 | Meriwether | B63C 3/12 114/48 |
| 5,281,055 | A | 1/1994 | Neitzke et al. | |
| 5,390,616 | A * | 2/1995 | Roth | B63C 3/06 114/44 |
| 5,628,274 | A | 5/1997 | Biedenweg et al. | |
| 6,006,687 | A | 12/1999 | Hillman et al. | |
| 6,477,968 | B2 | 11/2002 | Powell | |
| 6,840,188 | B1 | 1/2005 | Witbeck | |
| 7,100,527 | B2 | 9/2006 | Munro | |
| 7,182,030 | B2 | 2/2007 | Privette | |
| 7,293,522 | B1 | 11/2007 | Elson | |
| 8,225,734 | B2 | 7/2012 | Huizenga | |
| 8,256,366 | B2 | 9/2012 | Imel et al. | |
| 8,381,673 | B2 | 2/2013 | Wirsig | |
| 8,770,130 | B2 | 7/2014 | Holmes | |
| 9,051,035 | B2 | 6/2015 | Imel et al. | |
| 2001/0015163 | A1* | 8/2001 | Powell | B63C 1/04 114/46 |
| 2002/0132537 | A1 | 9/2002 | Hey | |
| 2005/0172876 | A1 | 8/2005 | Ostreng et al. | |
| 2006/0272566 | A1 | 12/2006 | Rueckert | |
| 2009/0044739 | A1* | 2/2009 | Imel | B63B 3/08 114/263 |
| 2009/0044740 | A1 | 2/2009 | Imel et al. | |
| 2009/0145345 | A1 | 6/2009 | Newcomb | |
| 2010/0067985 | A1* | 3/2010 | Imel | B63C 3/06 405/3 |
| 2010/0247243 | A1* | 9/2010 | Imel | B63C 3/02 405/3 |
| 2012/0152163 | A1 | 6/2012 | Holmes | |
| 2012/0199059 | A1 | 8/2012 | Spitzack | |

OTHER PUBLICATIONS

Kayak Dock web page, www.kayakdock.com/, printed Feb. 17, 2016, (13 pages).

Kollar Kyak Launch System Web Page, http://kollarkayaklaunchsystem.com; printed Feb. 17, 2016 (2 pages).

Cellofoam PermaFloat web page, http://cellofoam.com/Permafloat.htm, printed Feb. 17, 2016 (6 pages).

* cited by examiner

SMALL WATERCRAFT LAUNCH

CROSS-REFERENCE TO RELATED APPLICATIONS

This application claims priority to U.S. App. No. 62/428,365, filed Nov. 30, 2016, entitled Small Watercraft Launch, and which is incorporated herein by reference.

STATEMENT REGARDING FEDERALLY SPONSORED RESEARCH OR DEVELOPMENT

Not Applicable.

BACKGROUND

This application relates to launches for small watercraft.

In U.S. Pat. No. 8,256,366, we disclosed a launch for small watercraft, such as canoes and kayaks. The watercraft launch disclosed therein works well for its intended purpose, but can be improved upon to make it more versatile, and easier for some to use.

BRIEF SUMMARY

Briefly stated, a small watercraft launch comprises a watercraft receiving area defined by a bottom and side walls which in combination define a cradle. Opposed launch side walls, extending generally the length of the small water craft launch, extend upwardly from the cradle side walls. The launch sidewalls have an inner surface, an outer surface and a top surface. At least one of the side walls defines a port to enable access to the cradle (and to a watercraft positioned in the cradle). The side walls further include a plurality of aligned notches extending downwardly from the launch sidewall top surface on opposite sides of the port which are sized to receive an oar/paddle shaft to allow a boater to pull the small watercraft forward along the small watercraft launch. Lastly, the small watercraft launch has a connecting portion at a bottom of the outer surface of at least one of the launch side walls, and which is configured to connect the small watercraft launch to a dock member.

The small watercraft launch can include any of the following aspects in any desired combination.

In accordance with one aspect, the cradle is sized and shaped to maintain a small watercraft in a generally upright position when received in the watercraft receiving area. To this end, the side walls of the cradle preferably are spaced apart a distance that is slightly greater than the average width of a small watercraft, such as a canoe or kayak.

In accordance with another aspect, the side walls of the cradle slope upwardly and outwardly.

In accordance with an aspect, the small watercraft launch can include ribs extending longitudinally along the side walls of the cradle and/or along the bottom of the cradle.

In accordance with an aspect, bunks are secured to the cradle bottom between the bottom ribs. If desired, the bunks can have a height greater than a height of the ribs.

In accordance with an aspect, the small watercraft launch includes a central channel extending longitudinally the length of the bottom of the cradle, with the channel being open at opposite ends of the cradle bottom.

In accordance with an aspect, the watercraft receiving area comprises ramped entrance and exit surfaces at opposite ends thereof. Preferably, the ramped entrance and exit surfaces each have a pair of approach edges, with each of the approach edges of each pair of approach edges having a first end proximate a side wall of the cradle and a second end proximate a side-to-side center of the cradle, such that the approach edges define approach areas to guide a small watercraft into the cradle.

In accordance with an aspect, the notches of the launch side walls each include a first end surface closer to the port, a second end surface closer to an end of the launch, and a bottom surface extending between bottom ends of the first and second end surfaces; wherein at least the second end surface is generally vertical.

In accordance with an aspect, the top surfaces of the launch side walls define end portions which ramp upwardly and generally horizontal mid-portions.

In accordance with an aspect, the end portion of the launch side walls defines a curve.

In accordance with an aspect, the bottom surfaces of the notches are generally parallel to the top surface of the launch wall.

In accordance with an aspect, the connecting portion is a first connecting portion, and the small watercraft launch includes a second connecting portion at the bottom of the outer surface of the other of the launch side walls. This second connecting portion can have a height less than a height of the first connecting portion.

BRIEF DESCRIPTION OF THE DRAWINGS

Corresponding reference numerals will be used throughout the several figures of the drawings.

DETAILED DESCRIPTION

Figure 1:
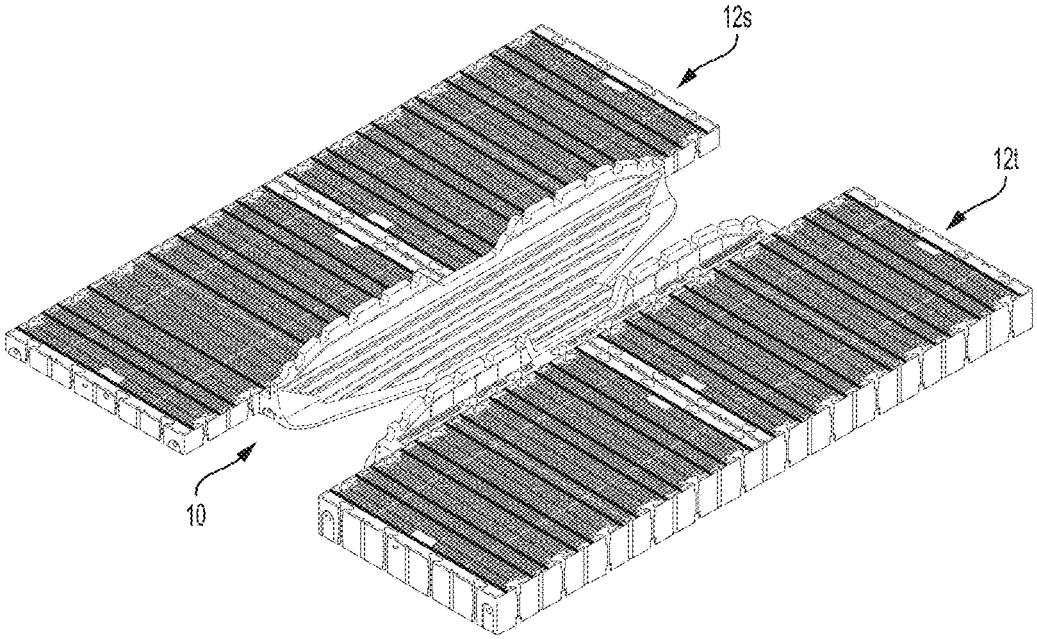
FIG. 1 is a perspective view of a small watercraft launch connected to a pair of dock members to be between the dock members.

The following detailed description illustrates the claimed invention by way of example and not by way of limitation.

This description will clearly enable one skilled in the art to make and use the claimed invention, and describes several embodiments, adaptations, variations, alternatives and uses of the claimed invention, including what we presently believe is the best mode of carrying out the claimed invention. Additionally, it is to be understood that the claimed invention is not limited in its application to the details of construction and the arrangements of components set forth in the following description or illustrated in the drawings. The claimed invention is capable of other embodiments and of being practiced or being carried out in various ways. Also, it is to be understood that the phraseology and terminology used herein is for the purpose of description and should not be regarded as limiting.

Figure 3:
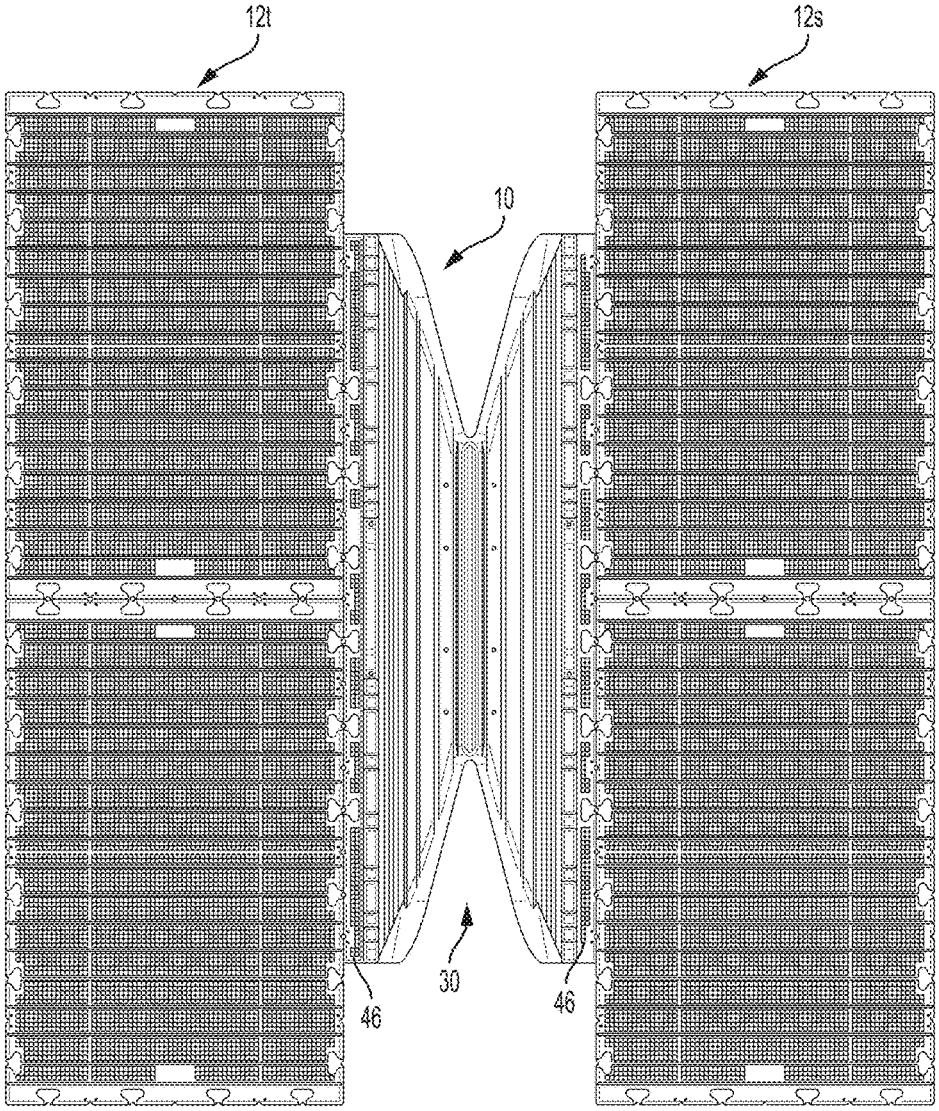
FIG. 3 is a top plan view of the small watercraft launch connected between dock members.
Figure 4:
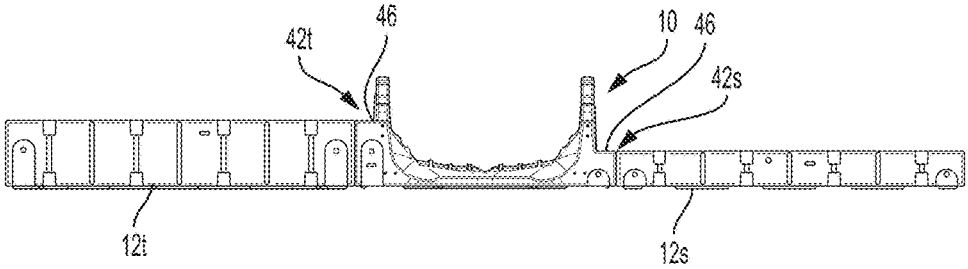
FIG. 4 is an end elevational view of the small watercraft launch connected between dock members.

FIGS. 1, 3, and 4 show a small watercraft launch 10 positioned between opposed dock members 12T and 12S and connected to the dock sections. As best seen in FIG. 4, the dock members 12T are of a first height, and the dock members 12S are of a second height, which is less than the first height. Preferably, the dock members 12T are full height dock members, and can have height, for example, of about 15" (about 38 cm); and the dock members 12S are about ½ the height of the dock members 12T, and are thus have a height of about 8" (about 20 cm).

Figure 2:
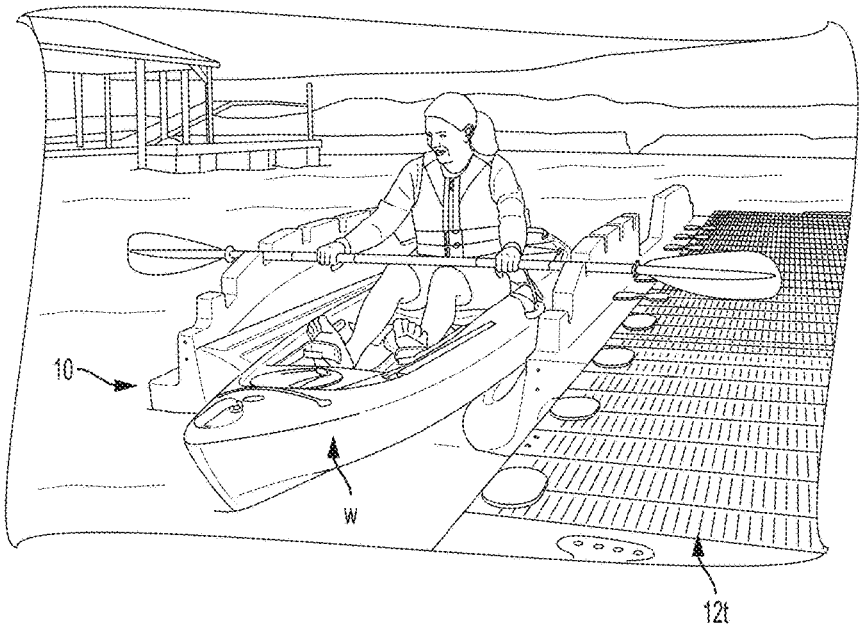
FIG. 2 is a view of the small watercraft launch connected to a single dock member and shown in use.

The small watercraft launch 10 is shown in better detail in FIGS. 5-13. The small watercraft launch 10 has a watercraft receiving section 14 having a bottom surface 16 and outwardly and upwardly sloping side walls 18, which, in combination, define a cradle 20. As seen in FIG. 2, the cradle 20 has a side-to-side width which is not significantly larger than the width of the watercraft W to be received in the cradle 20. Thus, the watercraft W, when received in the small watercraft launch 10, will be retained in a substantially upright position. As can be appreciated, this will make the watercraft more stable in the small watercraft launch when a user is propelling the watercraft onto or off of the launch 10, and when getting into and out of the watercraft.

The bottom surface 16 of the cradle 20 slopes upwardly from a generally central channel 24 to the cradle side walls 18. Preferably, the slope of the bottom surface 16 is a shallow slope sufficient to allow for water on the small watercraft launch to flow towards the channel 24. As seen, the central channel 24 extends the length of the bottom surface 16, and is open at the opposite ends of the surface 16, thereby allowing water in the channel to drain from the small watercraft launch. The bottom surface 16 is generally flat along the length of the surface.

A plurality of ribs 26 extend upwardly from the surface 16 and from the side walls 18. The ribs 26 are generally parallel to each other and are shown to extend the length of the surface 16 and side walls 18. The ribs also aid in facilitating water to flow off the small watercraft launch. In addition, the ribs 26 will elevate a small watercraft above water that may be on the surface of the small watercraft launch to keep the craft out of the water. The ribs 26 define channels 28.

The cradle 20 further defines entrance and exit sections 30 at opposite ends of the small watercraft launch 10. As seen in the figures, the entrance and exit sections 30 are generally identical, such that the cradle 20 is generally symmetrical about both a longitudinal axis and a transverse axis. The entrance/exit sections 30 comprise edges 32 which extend outwardly from the central channel 24. The entrance sections 30 further include sloped ramp surfaces 34 which extend upwardly from the edges 32. The converging edges 32 and the sloped entrance/exit surfaces 34 facilitate guiding a watercraft into the cradle 20 and then onto the cradle surface 16. As seen in the figures, the edges 32 of the entrance/exit sections define a general V-shape. However, the edges could be more U-shaped, or perhaps even semi-circular. Alternatively, the entrance/exit sections 30 could simply be defined by a ramped portion.

Figure 8:
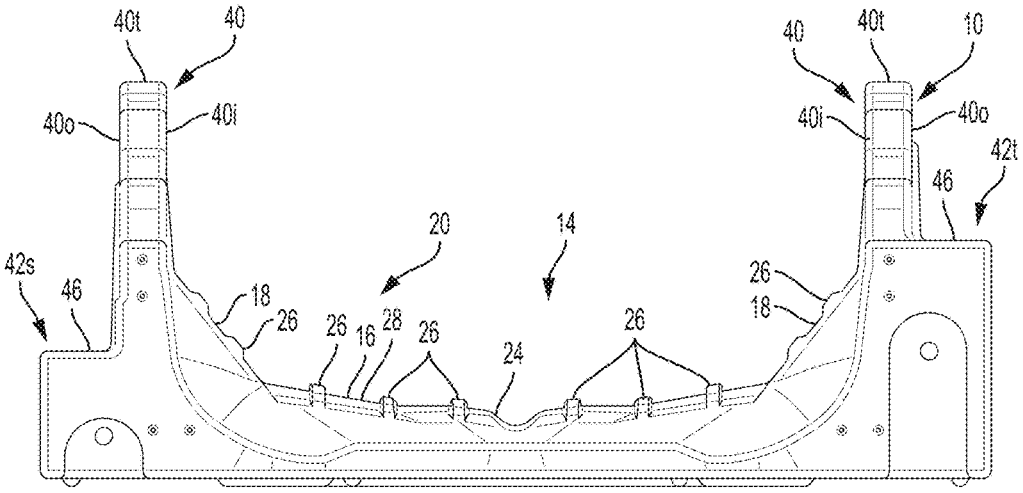
FIG. 8 is an end elevational view of the small watercraft launch; the front and back views being the mirror images of each other.

The small watercraft launch 10 includes side walls 40, having inner surfaces 40*i*, outer surfaces 400, and a top surface 40*t*. The side wall inner surfaces 40*i* extend upwardly, and preferably vertically, from the cradle side walls 18. The side wall outer surfaces 40*o* are generally parallel to the inner wall surfaces 40*i*. Connecting portions 42*t* and 42*s* extend from the bottom of the outer surfaces 40*o* to connect the small watercraft launch 10 to the dock members 12T and 12S, respectively. To this end, the connecting portions 42*t,s* each include sockets 44 shown to extend downwardly from top surfaces 46 of the connecting portions and which are positioned to align with sockets on the dock members 12*t,s*. Connectors then are received in the opposed sockets of the dock members and the small watercraft launch. The sockets and connectors are formed to prevent substantial separation between the small watercraft launch and the dock members. For example the sockets and corresponding connectors are preferably such as are disclosed in U.S. Pat. No. 5,281,055, which is incorporated herein by reference. In addition, the sockets and corresponding connectors can be such as are disclosed in U.S. Pat. Nos. 7,243,608, 9,051,953, and 9,079,641, all of which are incorporated herein by reference. The sockets and connectors can have any other desired shape, as long as they will prevent substantial separation of the small watercraft launch 10 from the dock member(s) to which it is connected. As best seen in FIG. 8, the connecting portions 42*t* and 42*s* are of different heights, with the connecting portion 42*s* being about one-half the height of the connecting portion 42*t*. As seen in FIG. 4, the heights of the connecting portions 42*t,s* correspond to the heights of the two dock members 12T,S, such that the top surfaces 46 of the connecting portions are level with, and, appear to be a continuation of, the dock members when the small watercraft launch is connected with the dock members. If desired, the two connecting portions could be of the same height, and both could be full height connecting portions (to connect to the full height dock members 12T) or both could be half-height connecting portions (to connect to the half-height dock members 12S). The top surfaces 46 of the connecting portions 42*s,t* can be textured, if desired, to provide for better traction on the connecting portions when users step on the connecting portions.

Figure 5:
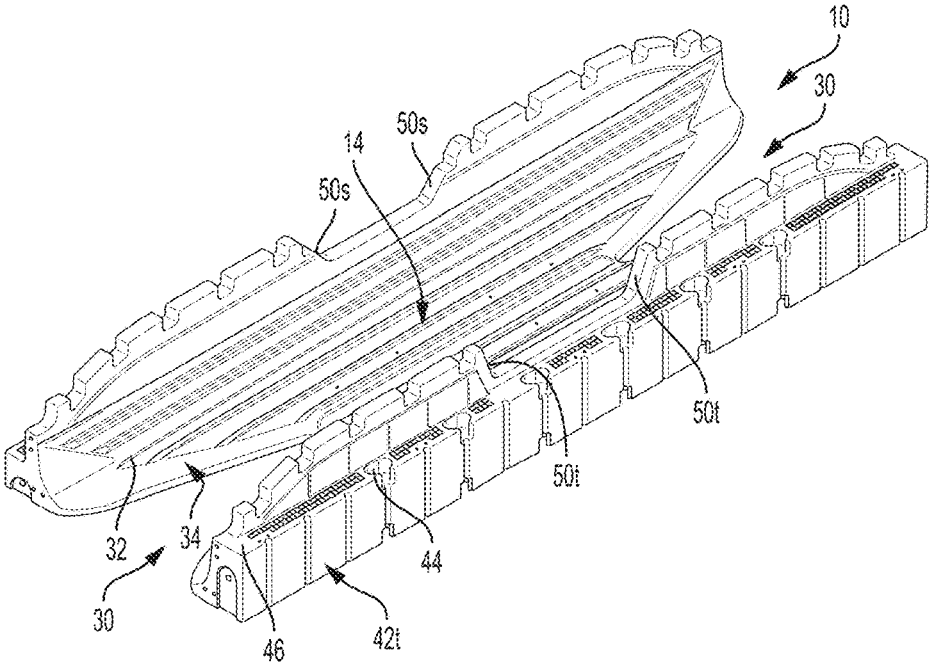
FIG. 5 is a perspective view of the small watercraft launch showing a tall or full height connection side of the small watercraft launch.
Figure 6:
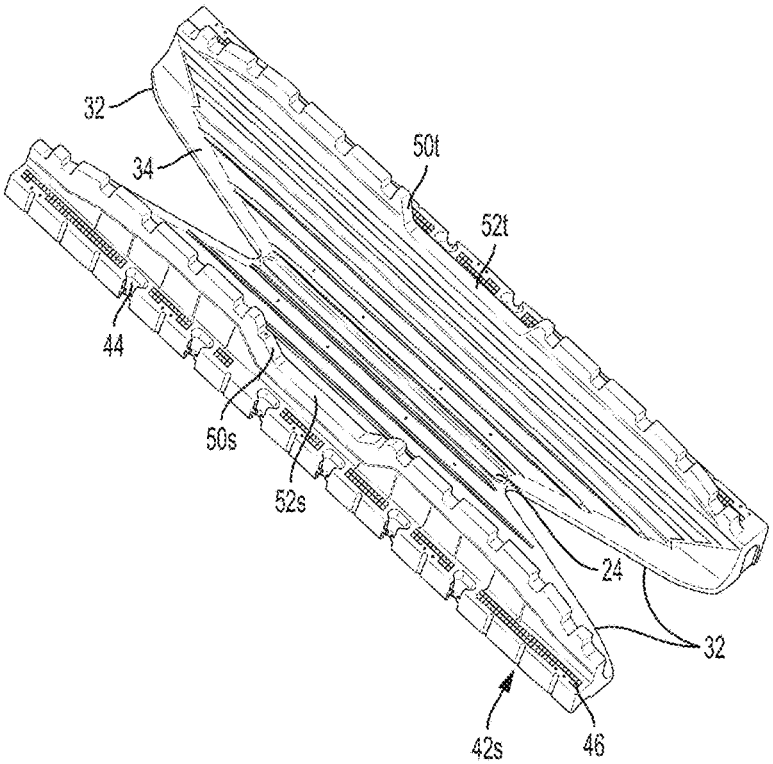
FIG. 6 is another perspective view of the small watercraft launch showing a short or half-height connection side of the small watercraft launch.
Figure 7:
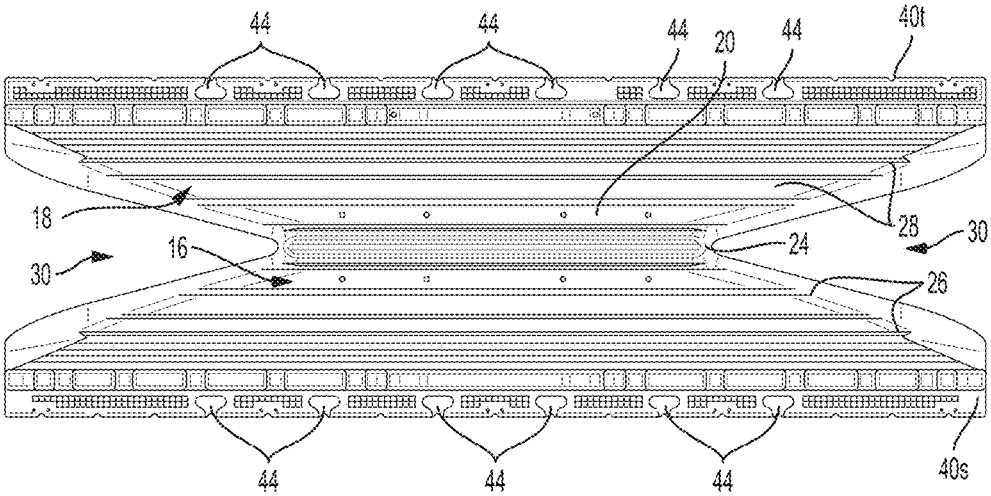
FIG. 7 is a top plan view of the small watercraft launch.
Figure 9:
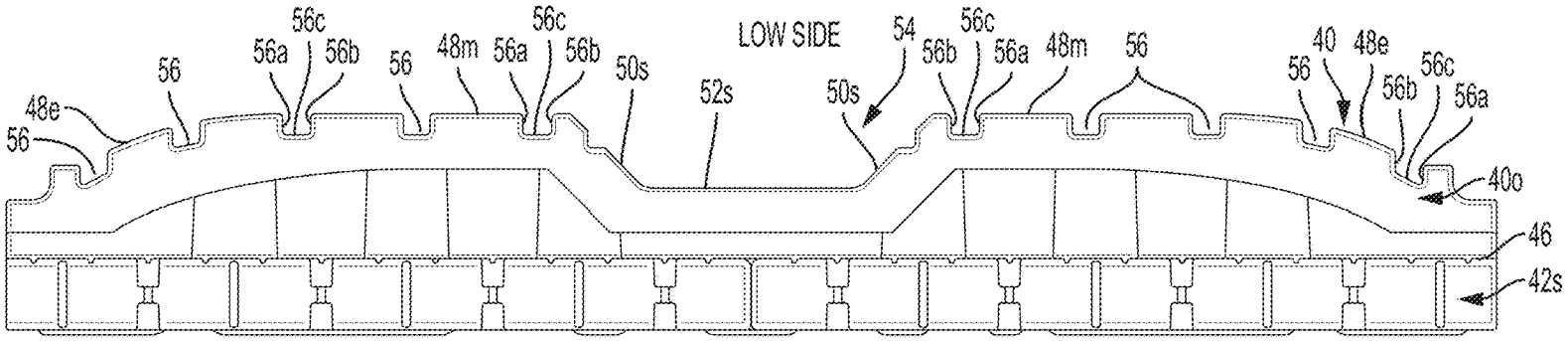
FIG. 9 is a first side elevational view of the small watercraft launch, showing the half-height connection side of the small watercraft launch.
Figure 10:
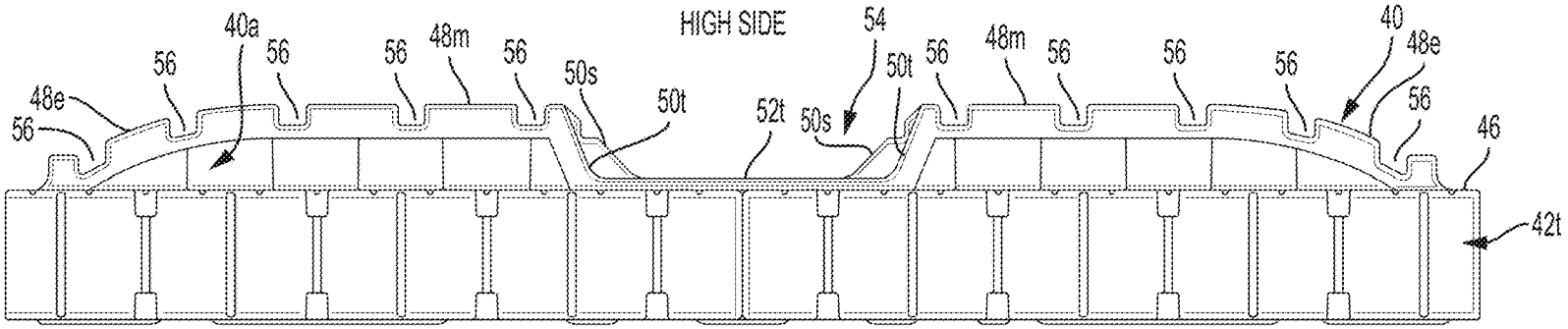
FIG. 10 is a second side elevational view of the small watercraft launch, showing full-height connection side of the small watercraft launch.
Figure 11:
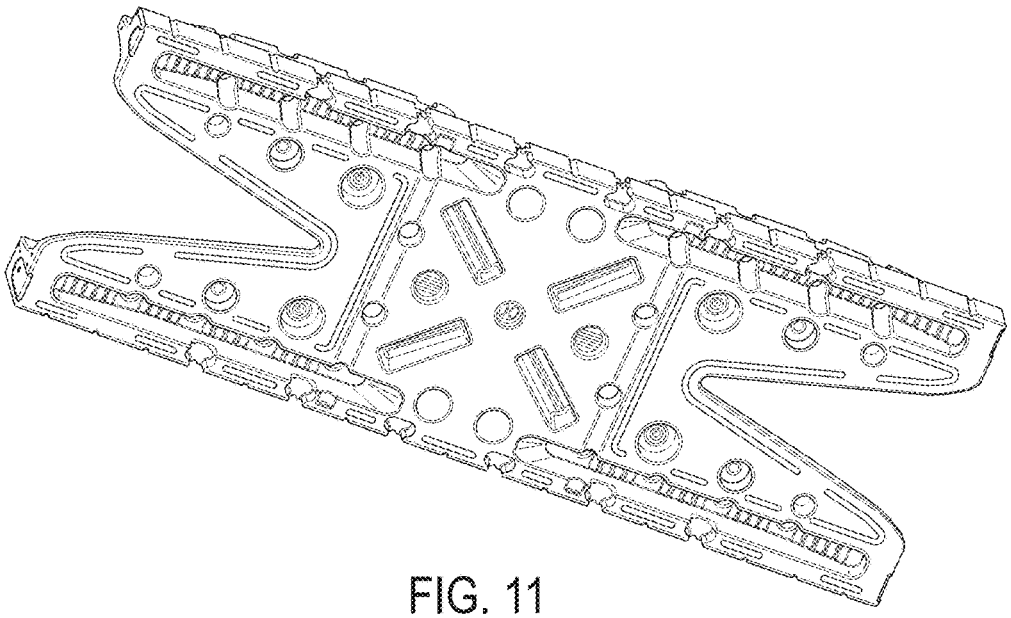
FIGS. 11 and 12 are a bottom perspective and bottom plan views, respectively, of the small watercraft launch.
Figure 12:
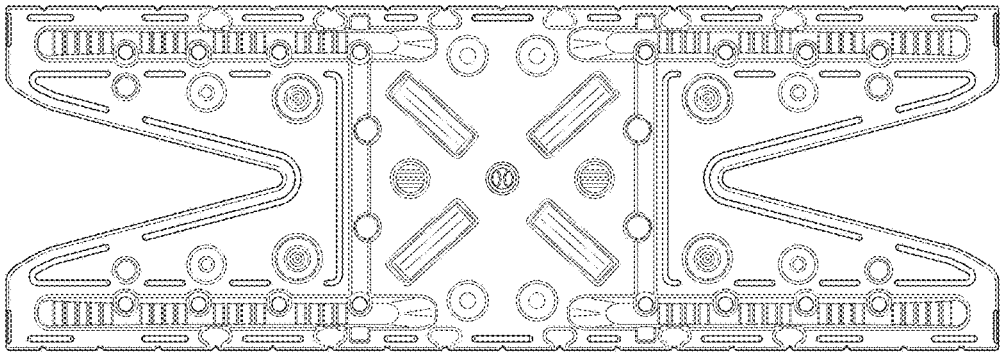

Turning to FIGS. 9 and 10, the top 48 of the side walls 40 have curved end portions 48*e* which lead to generally flat mid-portions 48*m*. The mid-portions 48*m* of the side wall extending upwardly from the full-height connecting portion 42*t* have downwardly sloping end walls 50*t*; and the mid-portions 48*m* of the side wall extending upwardly from the half-height connecting portion 42*s* has downwardly sloping end walls 50*s*. As seen in FIGS. 5 and 10, the end walls 50*t* are steeper in slope than the end walls 50*s*. The end walls 50*t,s* end in respective flat surfaces 52*t,s* which extend between the end walls 50*t,s*. The surfaces 52*t,s* are generally co-planer. That is, they lie essentially on the same horizontal plane which is slightly above the top edge of the side walls 18 of the cradle 20. Thus, the surface 52*t* is approximately level with the top surface 46 of the full-height connecting portion 42*t*, whereas the surface 52*s* is above the top surface 46 of the half-height connecting portion 42*s*. The end walls 50*t,s* and their respective flat surfaces 52*t,s* define ports 54 through the side walls 40, through which users can pass to enter and exit watercraft docked in the cradle 20.

Additionally, the walls 40 include notches 56 which extend downwardly from the top surfaces 40*t* of the side walls 40. The notches 56 in the two side walls are aligned with each other. As seen, the notches 56 include end surfaces 56*a,b* and a bottom surface 56*c*. As seen, the end wall 56*a* which is closest to a respective end of the small watercraft launch 10 is vertical. Preferably, both end walls 56*a,b* of the notch are vertical. Additionally, the bottom surface 56*c* of each notch 56 is generally parallel to the top surface 40*t* of the side wall 40. Thus, the notches 56 in the end sections 48*e* have slopping bottom surfaces and the notches in the mid-sections 48*m* are generally horizontal. As shown in FIG. 2, the notches can be used to receive oars, and a user can place an oar in the notches to extend across the small watercraft launch 10 to pass through a pair of opposing notches. The user can then pull on the oar to propel the watercraft forward, either onto, or off of, the small watercraft launch. The generally vertical nature of the notches provides for an opening to the notch which is substantially the same length as the bottom surface of the notch. This facilitates withdrawal of the oar from the notch during use; and, the oar will not be caught in the notch, as might happen if the notch walls sloped inwardly, such that the bottom of the notch was longer than the entrance to the notch. This is, in particular, facilitated by the generally vertical end wall 56*a* of the notches 56.

As can be appreciated, in use, a user will dock a small watercraft, such as a kayak or canoe, on the small watercraft launch by propelling the small watercraft toward the entrance section 30 of the small watercraft launch. The guiding edges 32 of the entrance section will align the watercraft with the cradle 20. As the user propels the watercraft forwardly, the front of the watercraft will ride up the ramped surfaces 34 of the entrance section. If the momentum of the watercraft does not propel the watercraft fully into the cradle 20, the user can then place an oar in opposed notches and use the oar to pull the watercraft forwardly until the watercraft is fully received in the cradle 20. To this end, the side walls, with their aligned notches, define a generally horizontal ladder. Preferably, the watercraft is positioned such that the user is generally aligned with the port 54, to allow the user to easily exit the small watercraft launch. To propel a watercraft off the small watercraft launch 10, the user can enter the watercraft through a port 54. Once positioned in the watercraft, the user can place the oar in opposing notches to pull the watercraft forward, as is demonstrated in FIG. 2. Once the watercraft is mostly off the cradle surface, the user can use the oar in a typical manner to fully move the watercraft into the water. As noted above, the shape of the cradle keeps the watercraft substantially upright as the watercraft is propelled onto or off of the small watercraft launch 10, or as a user enters or exits the watercraft.

Figure 13:
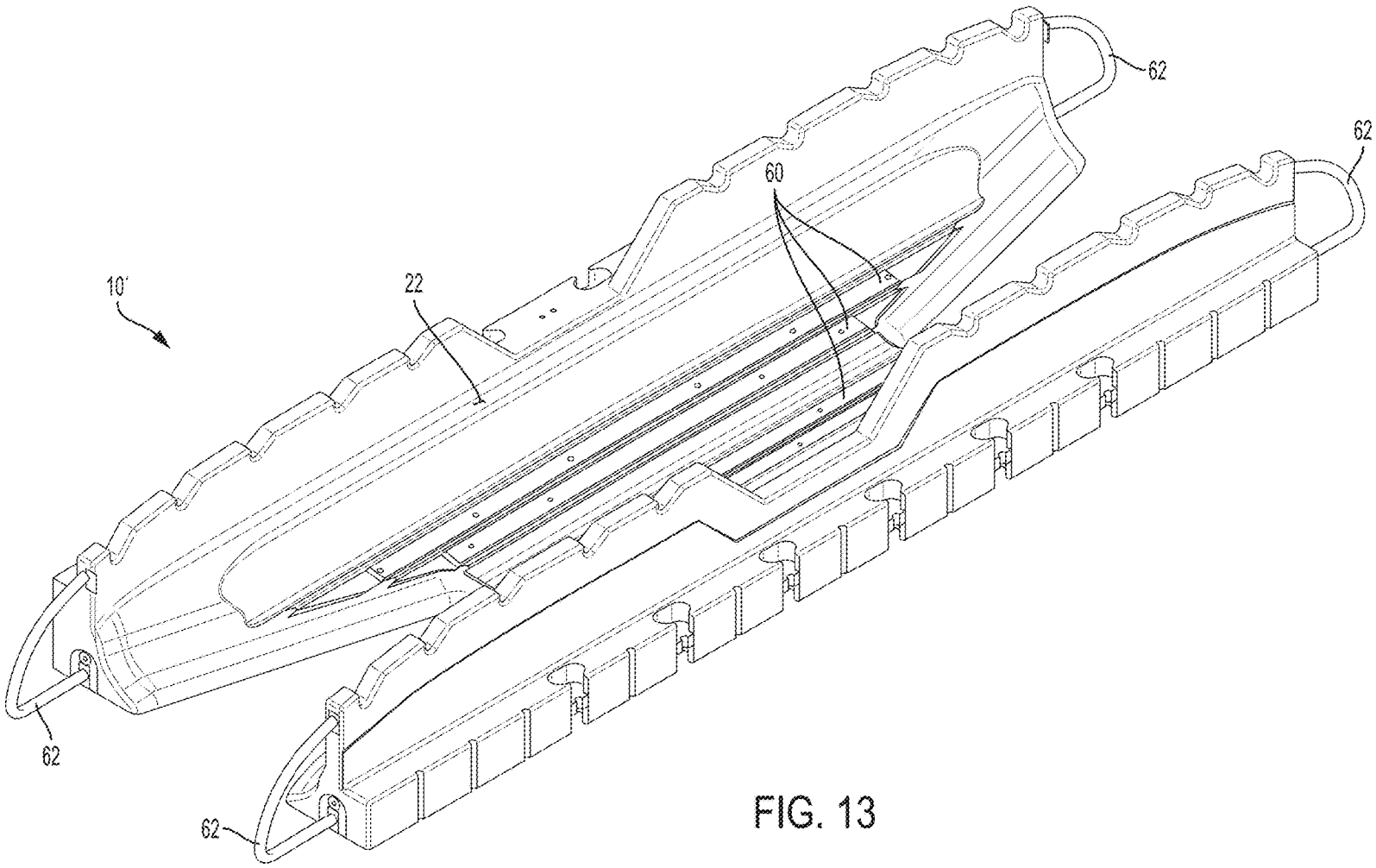
FIG. 13 is a perspective view of the small watercraft launch with optional railing extensions and optional bunk lifts.
Figure 14:
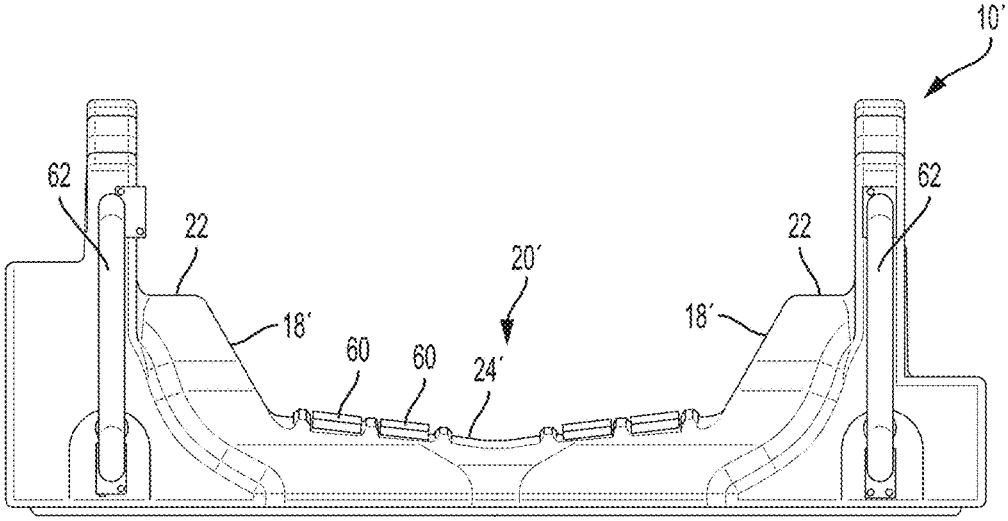
FIGS. 14 and 15 are front and back end views of the small watercraft launch with the optional railing extensions and bunk lifts.
Figure 15:
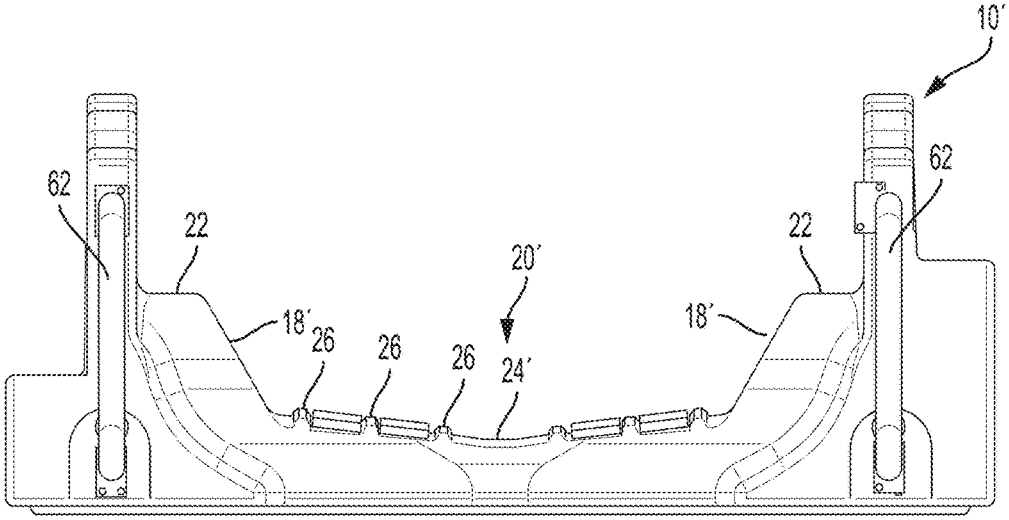

FIGS. 13-15 show an alternative embodiment of the small watercraft launch. This small watercraft launch is substantially similar to the small watercraft launch of FIGS. 1-12, but varies in small details. For example, the cradle 20' is shown to have flat upper surfaces 22 which extend outwardly from the top edge of the cradle side walls 18 to the side walls 40 of the small watercraft launch. The central channel 24' is wider and flatter than the channel 24 of the small watercraft launch 10. The cradle 20' includes the ribs on the cradle bottom surface, but the cradle side walls 18' are smooth (and thus do not include the ribs 26). As seen in FIGS. 13-15, the small watercraft 10' is shown with optional bunks or inserts 60 positioned in the channels defined by the rigs 26 and secured to the bottom surface of the cradle with fasteners, such as screws. As seen in FIGS. 14 and 15, the bunks 60 have a height about equal to the ribs 26, and can thus be used to further elevate the watercraft above the level of any water on the small watercraft launch. The bunks 60 can be stacked, if desired, to further elevate a watercraft that is received in the small watercraft launch. Preferably, the bunks are made from a material having a lower friction value than the launch itself. For example, the bunks 60 can be made from a high density polyethylene (HDPE).

Additionally, the small watercraft lift 10' is shown with end rails 62 which are mounted to the ends of the small watercraft lift. The end rails 62 can facilitate docking a longer small watercraft (such as a 17' kayak) in that the user can use the rails to pull the watercraft forward to a position which will allow the user to use the "horizontal ladder".

As various changes could be made in the above constructions without departing from the scope of the invention, it is intended that all matter contained in the above description or shown in the accompanying drawings shall be interpreted as illustrative and not in a limiting sense. For example, although the bottom surface 16 of the cradle 20 is shown to be generally solid, it could be perforated, or even be comprised of bars or slats which extend either length-wise or width-wise of the watercraft receiving area 14. This would provide for a watercraft receiving area which is more open to the water. This example is merely illustrative.

The invention claimed is:

1. A watercraft launch for watercraft comprising:

a watercraft receiving area defined by a bottom and sidewalls which in combination define a cradle;

opposed launch sidewalls extending upwardly from said sidewalls of said cradle; said opposed launch sidewalls each having an inner surface, an outer surface and a top surface; each of said opposed launch sidewalls extending substantially a length of said launch and defining a port through at least one of the opposed launch sidewalls to enable access to the cradle; said opposed launch sidewalls each including a plurality of notches extending downwardly from the top surface of each of said opposed launch sidewalls; the plurality of notches on a first of the opposed launch sidewalls being aligned with the plurality of notches on a second of the opposed launch sidewalls; and a connecting portion at a bottom of said outer surface of at least said first of said opposed launch sidewalls; said connecting portion being configured to connect said launch to a dock member.

2. The watercraft launch of claim 1 wherein the cradle is sized and shaped to maintain a watercraft in a generally upright position when received in the watercraft receiving area.

3. The watercraft launch of claim 2 wherein the sidewalls of the cradle are spaced apart a distance that is slightly greater than an average width of a watercraft, such as a canoe or kayak.

4. The watercraft launch of claim 2 wherein the sidewalls of the cradle slope upwardly and outwardly.

5. The watercraft launch of claim 2 including ribs extending longitudinally along the sidewalls of the cradle.

6. The watercraft launch of claim 2 including ribs extending longitudinally along a length of the bottom of the cradle.

7. The watercraft launch of claim 6 including bunks secured to the bottom of said cradle between the ribs.

8. The watercraft launch of claim 7 wherein the bunks have a height greater than a height of the ribs.

9. The watercraft launch of claim 2 including a central channel extending longitudinally the length of the bottom of the cradle; the central channel being open at opposite ends of the bottom of the cradle.

10. The watercraft launch of claim 1 wherein the watercraft receiving area comprises ramped entrance and exit surfaces at opposite ends of said watercraft receiving area.

11. The watercraft launch of claim 10 wherein the ramped entrance and exit surfaces each have a pair of approach edges, each approach edge of each pair of approach edges having a first end proximate a sidewall of the cradle and a second end proximate a side-to-side center of the cradle; said pairs of approach edges defining approach areas to guide a watercraft into the cradle.

12. The watercraft launch of claim 1 wherein said plurality of notches of said opposed launch sidewalls each include a first end surface closer to the port, a second end surface closer to an end of the launch, and a bottom surface extending between bottom ends of the first and second end surfaces; wherein at least the second end surface is generally vertical.

13. The watercraft launch of claim 1 wherein said top surface of said opposed launch sidewalls defines an end portion which ramps upwardly and a generally horizontal mid-portion.

14. The watercraft launch of claim 13 wherein said end portion of said opposed launch sidewalls defines a curve.

15. The watercraft launch of claim 12 wherein the bottom surface of said plurality of notches are generally parallel to the top surface of said opposed launch sidewall.

16. The watercraft launch of claim 1 wherein said connecting portion is a first connecting portion; said watercraft launch including a second connecting portion; said second connecting portion being at the bottom of an outer surface of the second of said opposed launch sidewalls.

17. The watercraft launch of claim 16 wherein said second connecting portion has a height less than a height of said first connecting portion.

* * * * *